US009895602B2

(12) United States Patent
Hendon

(10) Patent No.: US 9,895,602 B2
(45) Date of Patent: Feb. 20, 2018

(54) MODIFIED ROULETTE GAME

(71) Applicant: Rickey R. Hendon, Chicago, IL (US)

(72) Inventor: Rickey R. Hendon, Chicago, IL (US)

( * ) Notice: Subject to any disclaimer, the term of this patent is extended or adjusted under 35 U.S.C. 154(b) by 0 days.

(21) Appl. No.: 14/828,633

(22) Filed: Aug. 18, 2015

(65) Prior Publication Data

US 2017/0050107 A1 Feb. 23, 2017

(51) Int. Cl.
*A63F 5/00* (2006.01)
*A63F 5/02* (2006.01)

(52) U.S. Cl.
CPC ..... *A63F 5/007* (2013.01); *A63F 5/00* (2013.01); *A63F 5/0094* (2013.01); *A63F 5/02* (2013.01)

(58) Field of Classification Search
CPC ..... A63F 5/00; A63F 5/007; A63F 5/0094; A63F 5/02
USPC ..... 273/142 E, 142 H, 142 HA, 274, 138.1
See application file for complete search history.

(56) References Cited

U.S. PATENT DOCUMENTS 6,217,022 B1 * 4/2001 Astaneha ..... A63F 5/043 273/138.1
7,926,808 B1 * 4/2011 Gullotta ..... A63F 5/007 273/142 F
2004/0116179 A1 * 6/2004 Nicely ..... A63F 3/00157 463/25

* cited by examiner

*Primary Examiner* — Benjamin Layno
(74) *Attorney, Agent, or Firm* — Fraline J. Allgaier

(57) ABSTRACT

A modified roulette game comprising a roulette wheel apparatus having red, black, yellow and blue number pockets, a roulette wagering board and a plurality of wagering options. Each number pocket enabling a plurality of payout schemes. The numbers on the roulette board are arranged in four columns of nine, each column having even or odd numbers associated with the four colors. The wagering board providing a unique first wager group and second wager group allowing wagering on at least a single color, wagering on a single number where the number is associated with a single color, and active wager on the quadruple color scheme. The unique wagering options allowing for increased payout.

7 Claims, 4 Drawing Sheets

FIG. 3

| Bet Name | Winning Spaces | Payout |
|---|---|---|
| 0 | 0 (prior art) | 36 to 1 |
| 00 | 00 (prior art) | 36 to 1 |
| Straight Up | Any single number (prior art) | 36 to 1 |
| Street | Any four number horizontal (1,2,3,4 or 5,6,7,8 etc.) | 8 to 1 |
| Corner | Any four adjoining numbers in a block | 9 to 1 |
| First Column | 33, 29, 25, 21, 17, 13, 9, 5, 1 | 3 to 1 |
| Second Column | 34, 30, 26, 22, 18, 14, 10 6, 2 | 3 to 1 |
| Third Column | 35, 31, 27, 23, 19, 15, 11, 7, 3 | 3 to 1 |
| Fourth Column | 36, 32, 28, 24, 20, 16, 12, 8, 4 | 3 to 1 |
| First section | 1 through 12 (prior art) | 2 to 1 |
| Second section | 13 through 24 (prior art) | 2 to 1 |
| Third section | 25 through 36 (prior art) | 2 to 1 |
| Blue | 36, 29, 26, 23, 20, 13, 10, 7, 4 | 3 to 1 |
| Yellow | 35, 30, 25, 24, 19, 14, 9, 8, 3 | 3 to 1 |
| Black | 34, 31, 28, 21, 18, 15, 12, 5, 2 | 3 to 1 |
| Red | 33, 32, 27, 22, 17, 16, 11, 6, 1 | 3 to 1 |
| Four Color Flush | Four different colors in a row | 60 to 1 |

FIG. 4

| Spin Number | Color | Payout |
|---|---|---|
| 1 | Red | 1 to 1 |
| 2 | Red | 3 to 1 |
| 3 | Red | 36 to 1 |
| 1 | Black | 1 to 1 |
| 2 | Black | 3 to 1 |
| 3 | Black | 36 to 1 |
| 1 | Yellow | 1 to 1 |
| 2 | Yellow | 3 to 1 |
| 3 | Yellow | 36 to 1 |
| 1 | Blue | 1 to 1 |
| 2 | Blue | 3 to 1 |
| 3 | Blue | 36 to 1 |

MODIFIED ROULETTE GAME

BACKGROUND OF THE INVENTION

The embodiments of the present invention relate to a modified roulette game. Roulette is a popular casino game that has a long tradition of attracting crowds to a fun and exciting gaming experience. Players choose to place wagers on either a single number or a range of numbers on the pockets of a roulette wheel apparatus. The roulette game is traditionally played on a roulette table layout which is referred to as a single zero or a double zero layout.

The single zero layout is traditionally found in European casinos while the American casinos use a double zero format. The pockets of the roulette wheel apparatus are numbered from 1 to 36. In number ranges from 1 to 10 and 19 to 28, odd numbers are red and even numbers are black. In ranges from 11 to 18 and 29 to 36, odd numbers are black and even numbers are red. There is a green pocket numbered 0 (zero) and a second green pocket marked 00 (double zero). The inside of the wheel has a tilted circular track that engages a ball. Pocket number order on the roulette wheel apparatus adheres to the following clockwise sequence in most casinos:

Single-Zero Wheel 0-32-15-19-4-21-2-25-17-34-6-27-13-36-11-30-8-23-10-5-24-16-33-1-20-14-31-9-22-18-29-7-28-12-35-3-26

Double-Zero Wheel 0-28-9-26-30-11-7-20-32-17-5-22-34-15-3-24-36-13-1-00-27-10-25-29-12-8-19-31-18-6-21-33-16-4-23-35-14-2

In a traditional roulette game, players wager on the colors red or black or an odd or even number between 1 and 36. A dealer is typically appointed by a wagering establishment to conduct the game and to distribute wagers and payouts. The game begins when the dealer spins the wheel in one direction then spins a ball in the opposite direction around a tract embedded in the circumference of the wheel. The ball lands on a number between 1 and 36 as it loses its momentum in the circumference of the wheel.

Roulette players can place a variety of wagering options including inside and outside wagers. A player makes an inside wager by wagering on the exact number the ball will land or a small range of pockets based on the numerical configuration on the wheel. Outside wagers are based on a broader positioning of the numbers, a specific pocket color or whether a selected number will be odd or even.

House rules typically require minimum and maximum wagers that would apply individually to outside and inside wagering before the start of the game. Some casinos may utilize roulette table chips to distinguish the players at the table. The wagering begins when the ball begins to spin and terminates when the dealer officially announces that the wagering has stopped. The roulette wheel apparatus stops and the winning number and color are determined. The dealer then identifies the winning number on the roulette table layout and places a marker known as a dolly on the winning number. The presence of the dolly represents the end of a round and the players are prohibited from engaging any wagers that are on the table. The dealer first removes all losing wagers and pays out the winning wagers on the table layout. The players can start making new wagers after the dolly is removed.

Numerous roulette gaming devices have been developed over time. Wide ranges of inventive roulette games have been developed and are known in the prior art. Pertinent prior art relating to roulette wagering systems have been itemized below.

U.S. Pat. No. 8,517,384 by Anthony M. Carbonaro of New York describes a roulette game based on a wheel having multiple series of consecutive numbers. The color-scheme on the roulette wheel apparatus provides a unique number and color combination for each position on the wheel. This concept is predictable and does not provide the type of excitement associated with additional payouts and increased wagering options.

U.S. Pat. No. 3,819,186 by Adolf Hinterstocker Roggerdorf of Germany is an electronic roulette game having a simulated number cup and simulated number ball. The numbers on the roulette wheel apparatus correspond to numbers on the cup. The numbers are further divided into high and low numbers and colors. This roulette variation is confusing to play and lacks the excitement and clamor typically associated with roulette games.

A review of the above-referenced patents and other pertinent prior art does not teach a roulette type game which incorporates a plurality of color wagering options, having an improved column wagering system and providing bigger payouts. In addition, players can wager a progressive color-wagering board incorporating at least three spins of the roulette wheel apparatus. This progressive wagering option adds to the excitement of the game, provides improved payouts and maximizes profits for players.

SUMMARY

Accordingly, it is an object of the present invention to provide a modified roulette game that overcomes the problems with the aforementioned prior art.

It is another object of the present invention to provide a roulette game that incorporates at least four color options on the roulette wheel apparatus and the corresponding wager board.

It is still another object of the present invention to provide a roulette game with a plurality of wagering options.

It is a further object of the present invention to provide a roulette-type wagering game in which a first wager group and a second wager group enhances a player's wagering options.

BRIEF DESCRIPTION OF THE SEVERAL VIEWS OF THE DRAWING

FIG. 3 is a table illustrating the various wagers and payouts of the present invention.

FIG. 4 is an exemplary chart showing the payouts for the second wager group.

DETAILED DESCRIPTION OF THE DRAWINGS

Figure 1:
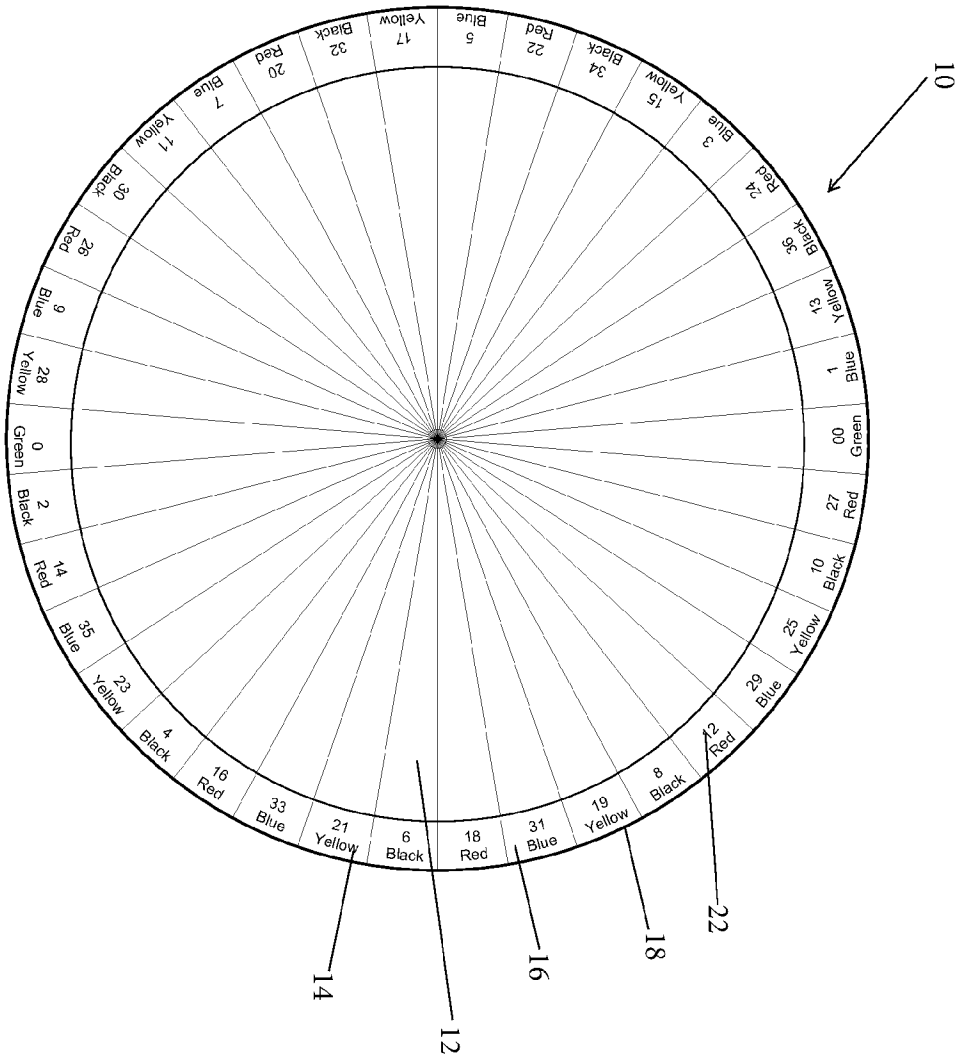
FIG. 1 illustrates a perspective view of the roulette wheel apparatus of the present invention.
Figure 2:
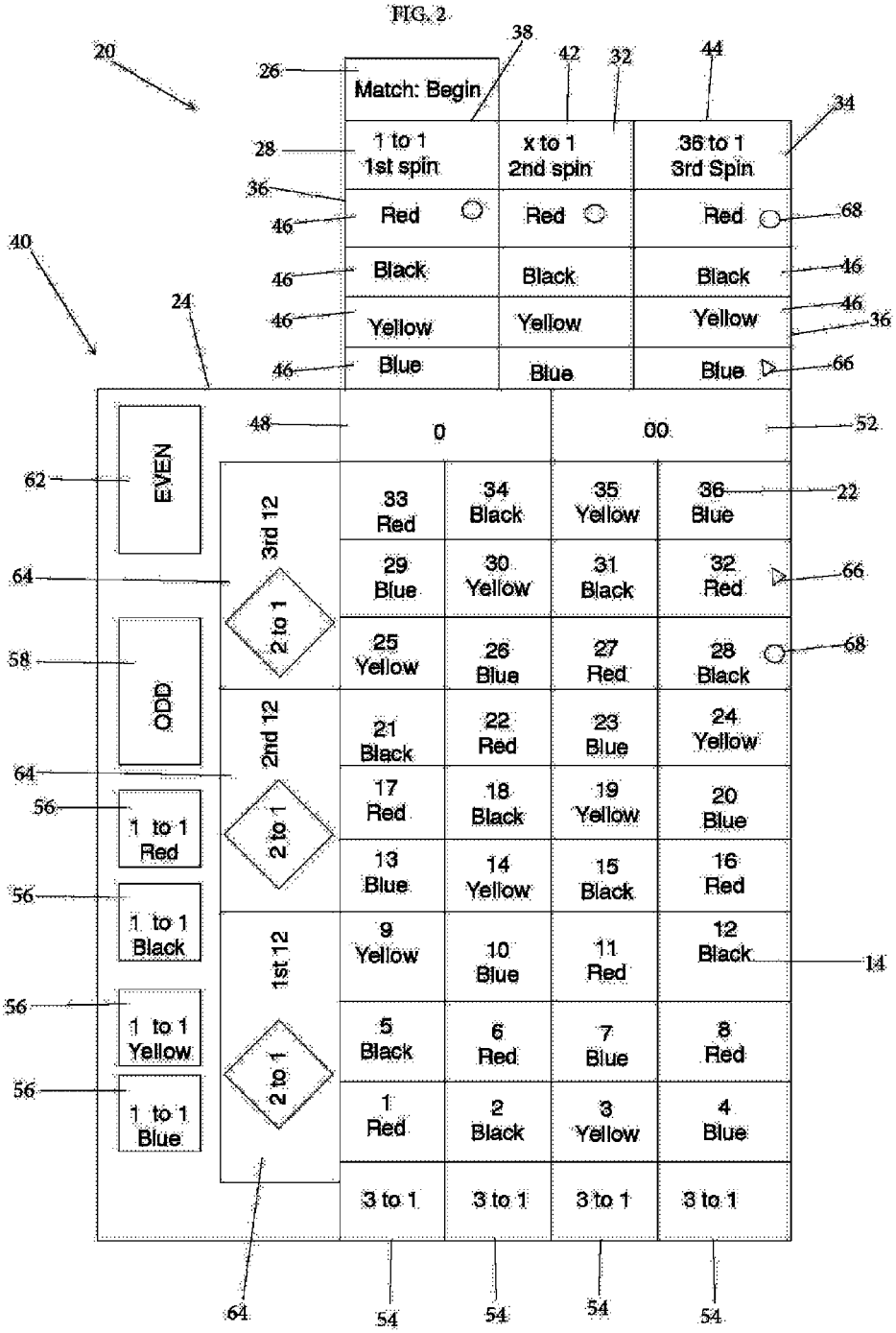
FIG. 2 illustrates a top view of the roulette wagering board for the roulette game of the present invention.

The present invention includes a modified roulette game comprising a standard sized roulette wheel apparatus 10 and a roulette wagering board 24 having a first wager group 20 and a second wager group 40. The roulette wheel apparatus 10 has a colored backdrop 12 with at least four colors 14, at least 38 number pockets 16 a wagering area 18 labeled with numbers 22 from 1 to 36, 0 and 00. The colors 14 alternate on the roulette wheel apparatus 10 and each consecutive number 22 is indicated with a different color 14. The clockwise sequence of the numbers 22 being 0 (green), 28 (yellow), 9 (blue), 26 (red), 30 (black), 11 (yellow), 7 (blue)

20, (red), 32 (black), 17 (yellow), 5 (blue), 22 (red), 34 (black), 15 (yellow), 3 (blue), 24 (red), 36 (black), 13 (yellow), 1 (blue), 00 (green), 27 (red), 10 (black), 25 (yellow), 29 (blue), 12 (red), 8 (black) 19 (yellow), 31 (blue), 18 (red), 6 (black), 21 (yellow), 33 (blue), 16 (red), 4 (black), 23 (yellow), 35 (blue), 14 (red) and 2 (black).

Similar to a traditional roulette game, a dealer is appointed by the wagering establishment to conduct the game and to distribute wagers and payouts. The game begins when the dealer spins the roulette wheel apparatus 10 in one direction then spins a ball in the opposite direction around a tract embedded in the circumference of the wheel 10. The ball lands on a number 22 between 1 and 36 as it loses its momentum in the circumference of the roulette wheel apparatus 10.

The progressive color-wagering board 20 and second wager group 40 of the roulette wagering board 24 are adapted to receive wagers from at least one player. The numbers 22 and colors 14 of the roulette wagering board 24 correspond to the numbers 22 and colors 14 of the number pockets 16 of the roulette wheel apparatus 10.

The first wager group is a progressive color-wagering board 20. The progressive color-wagering board 20 having a match announcement section 26 announcing the beginning and ending of betting on the progressive color-wagering board 20 in the first wager group, a first slot section designating a first spin 28, a second slot section designating a second spin 32, a third slot section designating a third spin 34, a first column designating a first spin 38, a second column designating a second spin 42, a third column designating a third spin 44, each of the columns 38, 42, 44 having the colors 14 being designated in a plurality of color slot sections 46, the colors 14 in the color slot sections 46 corresponding to the sequence of the colors 14 on the roulette wheel apparatus 10, each of the first wager group rows 36 corresponding to the colors 14 of the number pockets 16, the progressive color-wagering board 20 being adapted to announce the beginning of the first wager group. (New) said first slot section, said second slot section and said third slot section of claim 1 being independent wager sections and accepting wagers from a player.

The first slot section 32, the second slot section 34 and the third slot section 38 are independent wager sections. A bet being place on any section 32, 34, or 38 activates the first wager group and a player bets on a progressive wager value as shown on the progressive wager board 20. All winning bets on the first slot section 32, the second slot section 34 and said third slot section 38 receive payouts.

The dealer announces the beginning of the progressive color-wagering board 20 and at least one player places at least one wagering chip 68 in at least one color slot section 46 of the first column designating a first spin 38, the second column designating a second spin 42 or the third column designating a third spin 44. The dealer spins the roulette wheel apparatus 10 in one direction and a roulette ball in the opposite direction, and the dealer announces the winning number 22 and color 14 on the roulette wheel apparatus 10. The dealer removes the losing wagering chips 68 and makes a second spin of the roulette wheel apparatus 10 and announces the winning number 22 and color 14 on the roulette wheel apparatus 10. The dealer removes the losing wagering chips 68 and makes a third spin of the roulette wheel apparatus 10 and announces the winning number 22 and color 14 on the roulette wheel apparatus 10. The dealer removes the losing wagering chips 68 and dealer announces the end of the progressive color-wagering board 20. The progressive color-wagering board 20 can have a payout of 1 to 1 if a player places a wagering chip 68 in the color slot section 46 of the first column designating a first spin 38 and the color slots section 46 is a winning section. The progressive color-wagering board 20 can have a payout of 3 to 1 if a player places a wagering chip 68 in a color slot section 46 of the second column designating a second spin 42 and the color slot section 46 is a winning section. The progressive color-wagering board 20 can have a payout of 36 to 1 if a player places a wagering chip 68 in a color slot section 46 of the third column designating a third spin 44 and the color slot section 46 is a winning section. The dealer places a marker 66 on the winning color slot section 46 designating a first, second or a third spin. The dealer fulfills the award of the progressive color-wagering board 20 after three consecutive spins of the roulette wheel apparatus 10 and announces the end of the progressive color-wagering board 20.

The second wagering group 40 has 38 numbers 22 for accepting wagering chips 68. The numbers are 1-36, a 0 section 48 and a 00 section 52. The roulette wagering board 24 has the numbers 1 to 36 in consecutive order and the 0 section 48 and 00 section 52 are adjacent to the numbers 1 to 36. The second wagering group 40 has at least four columns. The columns 54 have at least nine numbers 22 grouped as even numbers or odd numbers. Each consecutive number 22 having a different color 14. The columns 54 are subdivided into high and low numbers 22 and corresponding to the consecutive order of the numbers 1 to 36 on the roulette wheel apparatus 10. Additional unique wagering options include wagering on a plurality of color fields 56 in the second wager group 40 and wagering options including, numbers 22 from 1 to 36, the 0 section 48, the 00 section 52, odd numbers 58, even numbers 62, and number sections 64. Additional wagering options are known in the prior art and are shown in Table 1 below.

This modified method of playing roulette will add a new level of excitement to the roulette gaming experience. Players will enjoy their casino experience by wagering on a plurality of color wagering options and an improved column wagering system that provide bigger payouts. In addition, player excitement and anticipation will increase as players wager a progressive color-wagering board 20 incorporating three spins of the roulette wheel apparatus that provide larger payouts and profits. The multiplier value of each spin can be decided by the wagering institution.

While the preferred embodiments of this invention are shown and described herein, it will be manifest to those skilled in the art that modifications of this invention may be made without departing from the spirit and scope of the inventive concept.

TABLE 1

| Wager Name | Winning Spaces | Payout |
|---|---|---|
| 0 | 0 | 36 to 1 |
| 00 | 00 | 36 to 1 |
| Straight Up | Any single number | 36 to 1 |
| Street | Any four number horizontal (1, 2, 3, 4 or 5, 6, 7, 8 etc.) | 8 to 1 |
| Corner | Any four adjoining numbers in a block | 9 to 1 |
| Six Lines | Any six numbers from two horizontal rows | 5 to 1 |
| First Column | 1, 4, 7, 10, 13, 16, 19, 22, 25, 28, 31, 34 | 3 to 1 |
| Second Column | 2, 5, 8, 11, 14, 17, 20, 23, 26, 29, 32, 35 | 3 to 1 |
| Third Column | 3, 6, 9, 12, 15, 18, 21, 24, 27, 30, 33, 36 | 3 to 1 |
| First section | 1through 12 | 2 to 1 |
| Second section | 13 through 24 | 2 to 1 |
| Third section | 25 through 36 | 2 to 1 |
| Red | 1, 3, 5, 7, 9, 12, | 1 to 1 |

TABLE 1-continued

| Wager Name | Winning Spaces | Payout |
|---|---|---|
| Black | 14, 16, 18, 19, 21, 23, 25, 27, 30, 32, 34, 36 2, 4, 6, 8, 10, 11, 13, 15, 17, 20, 22, 24, 26, 28, 29, 31, 33, 35 | 1 to 1 |

What is claimed is:

1. A modified roulette game apparatus comprising: a roulette wheel apparatus, a roulette wagering board with a second wagering group, said roulette wheel apparatus having at least 38 number pockets, a colored backdrop and at least four alternating colors, said colored backdrop of said roulette wheel apparatus is colored red, black, yellow and blue, each of said number pockets being a wagering area, said wagering area being labeled with numbers from 1 to 36, 0 and 00, said colored backdrop having a different alternating color, said colors enabling a plurality of payout schemes, said colors alternating on said wheel with each consecutive number having a different color, said wagering area having wagering area rules comprising that a wagering chip being placed on a selected number on said wagering area is deemed a winning wager if the results of a spin equals the selected number, said selected number being a losing wager if said selected number is not selected as the result of said spin; said numbers and said colors of said wagering board corresponding to said numbers and said colors of said number pockets of said roulette wheel apparatus; the modified roulette game further comprising:

a. a first wager group being a progressive color-wagering board, the progressive color-wagering board having a match announcement section announcing the beginning and ending of said progressive color-wagering board in said first wager group, a first slot section designating a first spin, a second slot section designating a second spin, a third slot section designating a third spin, a first column designating a first spin, a second column designating a second spin, a third column designating a third spin, each of said columns having said colors being designated in a plurality of color sections, said colors in said color sections corresponding to the sequence of said colors on said roulette wheel apparatus, each of said first wager group columns corresponding to said colors of said number pockets, said progressive color-wagering board being adapted to announce the beginning of said first wager group, said dealer announcing the beginning of said progressive color-wagering board, at least one player placing at least one wagering chip in at least one of said color sections of said first column designating a first spin, said second column designating a second spin and said third column designating a third spin, said dealer spinning said roulette wheel apparatus in one direction and a roulette ball in the opposite direction, said dealer announcing the winning number and color on said roulette wheel apparatus, said dealer removing the losing wagering chips, said dealer making a second spin of said roulette wheel apparatus and announcing said winning number and color on said roulette wheel apparatus, said dealer removing said losing wagering chips, said dealer making a third spin of said roulette wheel apparatus and announcing said winning number and color on said roulette wheel apparatus, said dealer removing said losing wagering chips, said dealer announcing the end of said progressive color-wagering board, said dealer placing a marker on said winning color section designating a first, second or a third spin, said dealer fulfilling said award, said progressive color-wagering board opening after three consecutive spins of said roulette wheel apparatus and said dealer announcing the end of said progressive color-wagering board.

2. The modified roulette game apparatus of claim 1, wherein said first slot section, said second slot section and said third slot section being independent wager sections and accepting wagers from a player.

3. The modified roulette game apparatus of claim 1, wherein said first slot section, said second slot section and said third slot section being independent wager sections.

4. The modified roulette game apparatus of claim 1, wherein said first slot section, said second slot section and said third slot section activating said first wager group.

5. The modified roulette game apparatus of claim 1, wherein said first slot section, said second slot section and said third slot section being a progressive wager value.

6. The modified roulette game apparatus of claim 1, wherein said first slot section, said second slot section and said third slot section providing payouts to a player.

7. The modified roulette game apparatus of claim 1, wherein said progressive color-wagering board automatically launching said first wager group when at least one player places at least one wagering chip in at least one of said color sections of said first column designating a first spin, said second column designating a second spin or said third column designating a third spin.

* * * * *